US006246852B1

(12) United States Patent
Branch, III et al.

(10) Patent No.: US 6,246,852 B1
(45) Date of Patent: Jun. 12, 2001

(54) GRID ELECTRODE FOR CORONA CHARGER

(75) Inventors: Warren G. Branch, III, Victor; David E. Hockey, Brockport; Gerald L. Kelly, Byron; George R. Walgrove, III, Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/438,937

(22) Filed: Nov. 12, 1999

(51) Int. Cl.[7] ..... G03G 15/02
(52) U.S. Cl. ..... 399/171; 250/324
(58) Field of Search ..... 399/171, 168, 399/170, 172, 173, 115; 250/324, 325, 326

(56) References Cited

U.S. PATENT DOCUMENTS 5,324,941 6/1994 Gross et al. ..... 250/324

*Primary Examiner*—Sophia S. Chen
*Assistant Examiner*—Hoan Tran
(74) *Attorney, Agent, or Firm*—Lawrence P. Kessler

(57) ABSTRACT

A grid electrode for attachment to a corona charger includes a series of substantially parallel grid wires extending in a longitudinal direction of the wires. A flat metallic plate member is formed integral with the wires at one of the longitudinal ends of the wires. A cap member is connected to the plate member. The cap member includes a cover segment having a surface that overlies and is in planar contact engagement with a substantial portion of a respective plate member with a thickness of at least 0.5 millimeters and the cover segment being formed of a material that is substantially electrically more resistive than the flat metallic plate member.

12 Claims, 5 Drawing Sheets

GRID ELECTRODE FOR CORONA CHARGER

BACKGROUND OF THE INVENTION

The present invention relates generally to corona charging devices for use in electrostatographic machines and more particularly to a grid electrode for connection to a corona charging device used in such machines.

Generally, the process of electrostatographic copying is executed by exposing a light image of an original document to a substantially uniformly charge photoreceptor member. Exposing the charge photoreceptor member to a light image selectively discharges the photoconductive surface thereof to create an electrostatic latent image of the original document on the photoreceptor member. The electrostatic latent image is subsequently developed into a visible image by a process in which charge developing material is deposited onto the photoconductive surface of the photoreceptor such that the developing material is selectively attracted to the image areas thereon. The developing material is then transferred from the photoreceptor member to a copy sheet on which the tone image may be permanently affixed to provide a reproduction of the original document. In a final step, the photoconductive surface of the photoreceptor member is cleaned to remove any residual developing material therefrom in preparation for successive imaging cycles.

The described process is well known and is useful for light lens copying from the original as well as the printing of documents from electronically generated or stored originals. Analogous processes also exist in other electrostatographic applications such as, for example, digital printing applications where latent images are generated by a modulated laser beam or LED print head.

In electrostatographic applications, it is common practice to use corona generating devices for providing electrostatic fields to drive various machine operations. Such corona devices are primarily used to deposit charge on the photoreceptor member prior to exposure to the light image for subsequently enabling toner transfer thereto. In addition, corona devices are used in the transfer of an electrostatic toner image from the photoreceptor to a transfer substrate, in tacking and detacking paper to or from the imaging member by applying a neutralizing charge to the paper, and, generally in conditioning the imaging surface prior to, during and after toner is deposited thereon to improve the quality of the xerographic output copy.

In order to control a voltage potential of electrostatic charge on the surface, such as a photoconductive (PC) surface, it is known to provide a grid electrode between the corona charger electrode(s) and the PC surface. The grid electrode provides a series of wires or narrow metal strips across the opening of the charger housing out of which opening corona ions arc free to travel from the one or more corona generating wire electrodes or strip electrodes in the corona charger housing to the PC surface. By electrically biasing the wires of the grid assembly to the voltage potential desired to be created upon the PC surface there can be provided charging of the PC surface to the level of the grid voltage even though voltage potential of the corona charger is considerably higher.

In known copier/duplicator products, the primary charger grid electrode is in close proximity with the film surface (less than 0.125 inches) to insure uniform charging performance. A ground stripe is located on one or both edges of the PC film loop to provide an electrical ground path to the film Q-layer. Due to film curl and the close proximity of the charger grid electrode, contact between the grid electrode and the film ground stripe can occur. This can cause problems:

a. Contact between the ground stripe and the grid will short out the grid causing a loss of grid voltage. This will result in the film voltage that is too low and image quality will be severely impacted.

b. When the ground stripe and the grid are almost touching, an arc can occur between the two surfaces. On a low level, the arc creates electrical noise that can interfere with the logic of the machine. Momentary loss of grid voltage due to the arc can cause image quality degradation. A high-energy arc can damage the film surface requiring it to be replaced.

This problem in the past has been solved in two ways.

a. The grid surface has been curved at the ends. The grid does not have to be in close proximity with the film over the film stripe since this is not in the active charging area.

b. Insulate the grid surface in the area over the ground stripe with insulating tape. This has been done in known copier/duplicator products because the curved grid approach cannot be used due to the need to have an active cleaning system in place. The curved grid may not allow sufficient room for the cleaning mechanism.

However, the insulating tape is subject to damage during normal machine operation, and can wear away. At some point in time, arcing or shorting out of the grid will occur.

It is an object of the invention to improve upon the grid electrodes of the prior art.

The invention and its various advantages will become more apparent to those skilled in the art from the ensuing detailed description of preferred embodiments, reference being made to the accompanying drawings

SUMMARY OF THE INVENTION

In accordance with the invention there is provided a grid electrode for attachment to a corona charger, the grid electrode comprising a series of substantially parallel grid wires extending in a longitudinal direction of the wires; a flat metallic plate member formed integral with the wires at one longitudinal ends of the wires; a cap member connected to the plate member, the cap member including a cover segment having a surface that overlies and is in planar contact engagement with a substantial portion of a respective plate member with a thickness of at least 0.5 millimeters and the cover segment being formed of a material that is substantially electrically more resistive than the flat metallic plate member.

BRIEF DESCRIPTION OF THE DRAWINGS

The subsequent description of the preferred embodiments of the present invention will be made with reference to the attached drawings, wherein.

DETAILED DESCRIPTION OF THE INVENTION

Because apparatus of the general type described herein are well known the present description will be directed in particular to elements forming part of, or cooperating more directly with the present invention. While the invention will be described with reference to an electrophotographic system the invention can be also used in other electrostatographic systems too.

Figure 1:
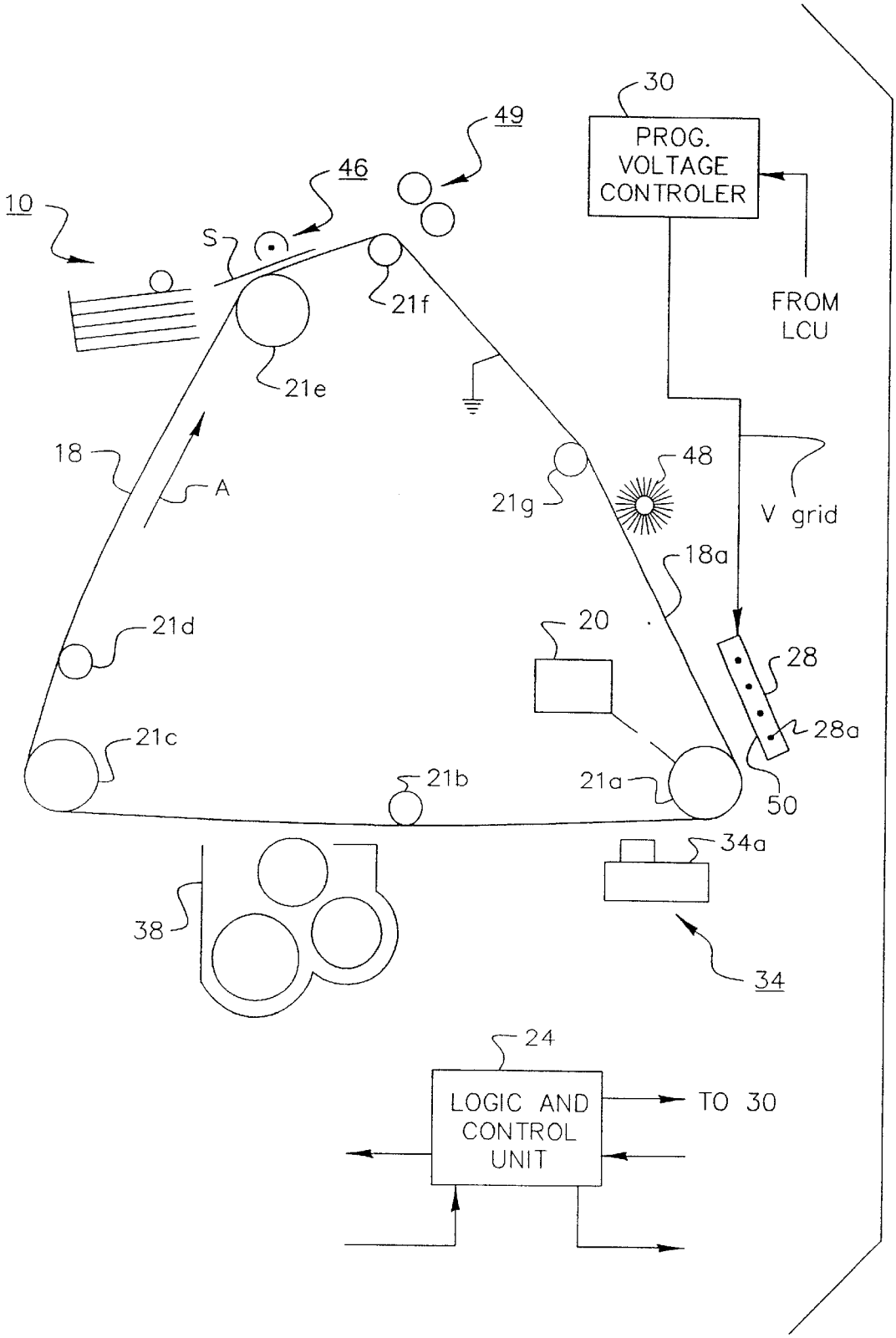
FIG. 1 is a schematic showing a side elevational view of an electrostatographic machine of the prior art and showing a primary corona charger having a grid electrode in accordance with the invention.

With reference to the electrostatographic copier and/or printer machine 10 as shown in FIG. 1, a moving recording member such as photoconductive belt 18 is entrained about a plurality of rollers or other supports 21*a–g* one or more of which are driven by a motor 20 so as to advance the belt in a direction indicated by an arrow A past a series of workstations of the copier/printer machine. A photoconductive drum may be used instead of the belt. A logic and control unit (LCU) 24, which has a digital computer, has a stored program for sequentially actuating workstations in response to signals from various sensors and encoders as is well known.

Briefly, a primary charging station 28 sensitizes the surface 18*a* of belt 18 by applying a uniform electrostatic charge of predetermined primary voltage to this surface of the belt. The output of the charging station is regulated by a programmable voltage controller 30, which is in turn controlled by LCU 24 to adjust primary voltage for example through control of electrical potential (Vgrid) to a grid electrode 50 that controls movement of corona charges from corona generating charging wires 28*a* to the surface of the recording member (PC) as is well known. The programmable voltage controller or other power supply provides a suitable electrical potential to the corona wires to cause the wires to generate corona charge which is attracted to the surface 18*a* as a layer beneath surface 18*a* is electrically conductive and is grounded.

At an exposure station 34, projected light from a write head 34*a* dissipates the electrostatic charge on the photoconductive belt to form an image of the document to be copied or printed. Travel of belt 18 thereafter brings the area bearing the latent charge image into a development station 38. The development station has one (more if color) device, such as a magnetic brush, for depositing electrostatically charged toner particles onto the belt surface 18*a* to selectively develop an electrostatic latent image with pigmented toner particles. A transfer station 46, as is also well known, is provided for moving a receiver sheet S into engagement with the photoconductive belt in register with the toner image for transferring the toner image to the receiver sheet. Alternatively, an intermediate member may have the image transferred to it and the image may then be transferred to the receiver sheet. The cleaning station 48 is also provided subsequent to the transfer station for moving toner from the belt 18 to allow reuse of the surface for forming additional images. In lieu of a belt, a drum photoconductor or other structure for supporting an image may be used. After transfer of the toner image to a receiver sheet, such sheet is detacked from the belt and transported to a fuser station 49 were the image is fixed.

The LCU provides overall control of the apparatus and its various subsystems as is well known. Programming of commercially available microprocessors is a conventional skill well understood in the art.

Figure 2:
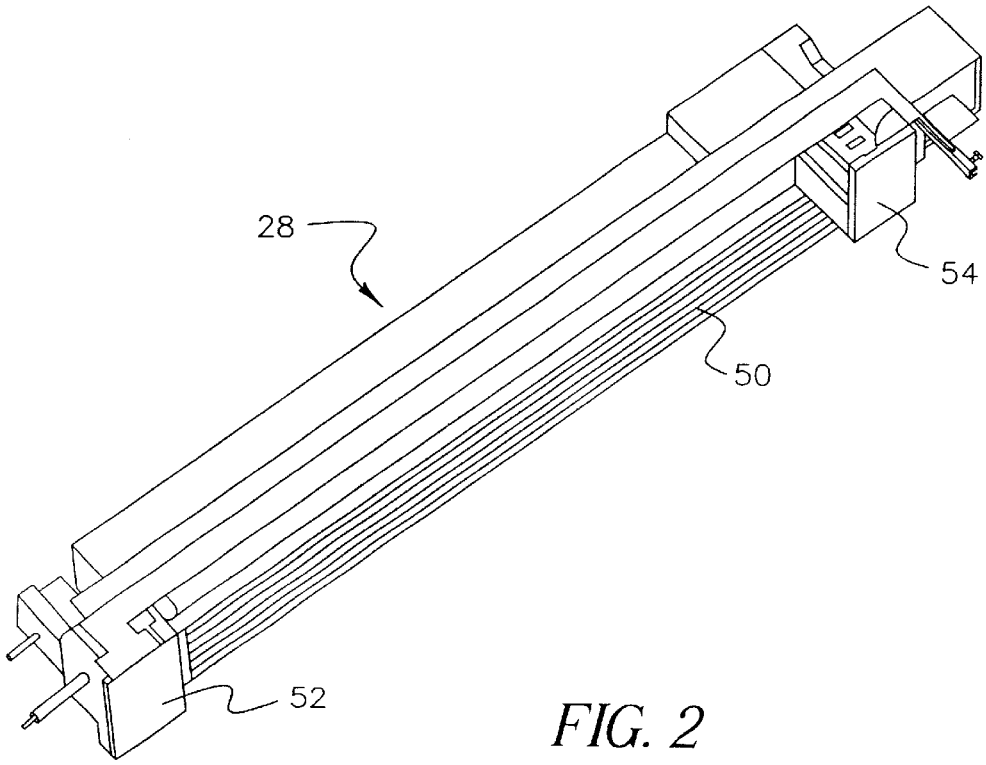
FIG. 2 is a perspective view of a corona charger having a grid electrode in accordance with the invention.
Figure 3:
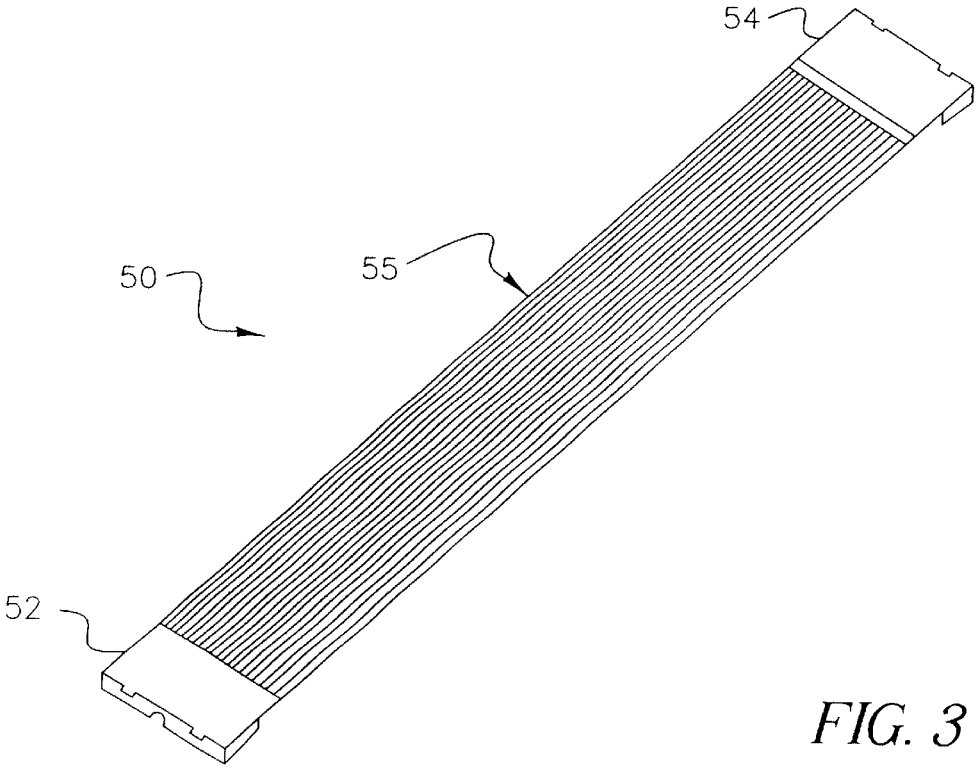
FIG. 3 is a prospective view of the grid electrode in accordance with the invention.
Figure 4:
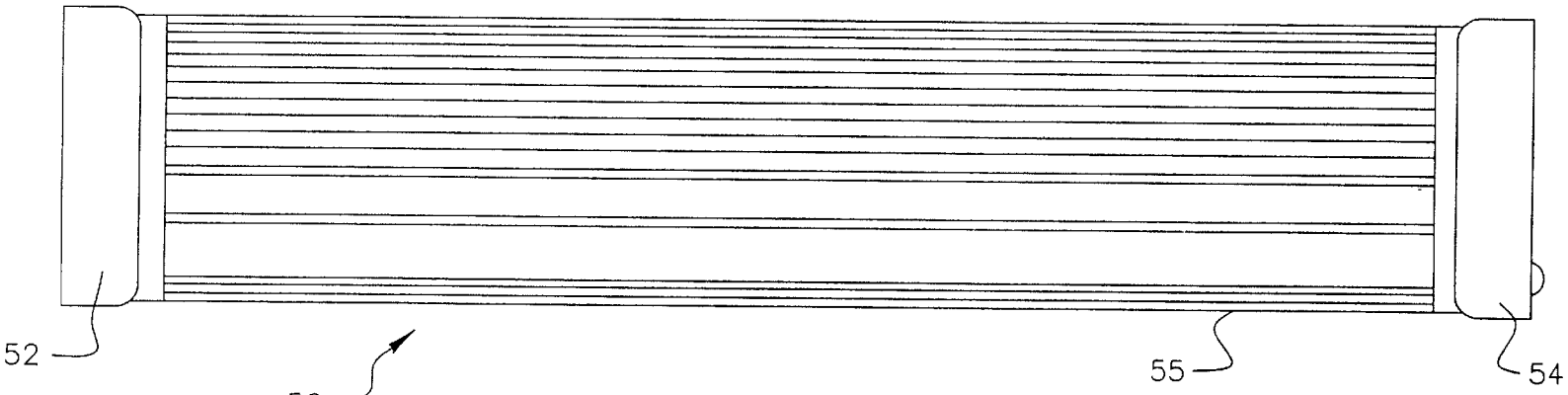
FIG. 4 is a top plan view of the grid electrode of FIG. 3.
Figure 5:
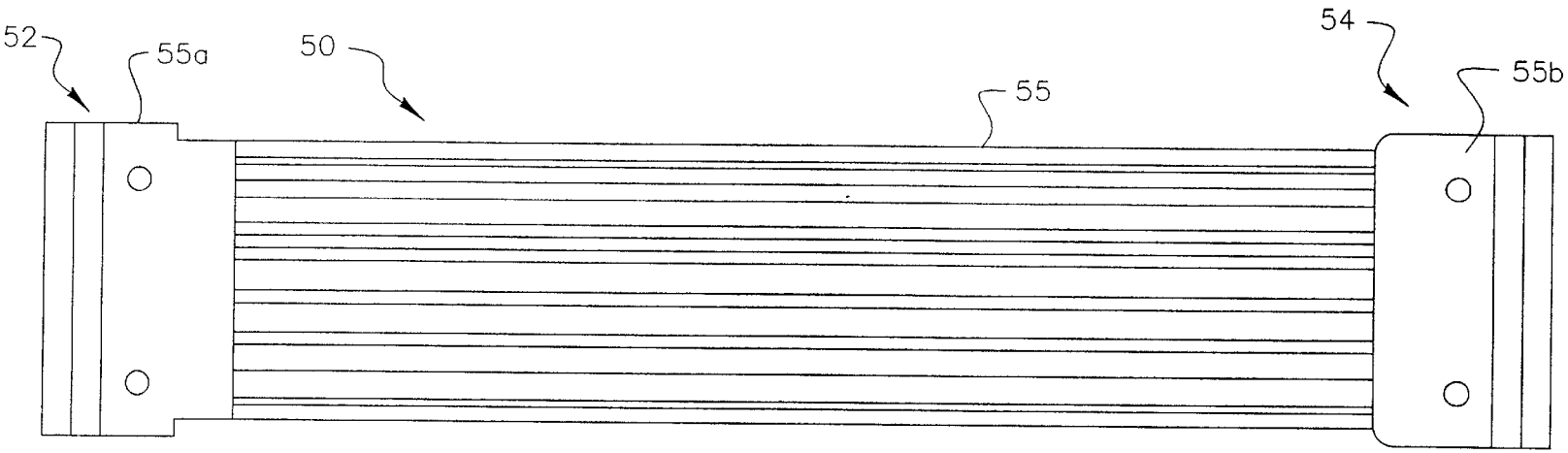
FIG. 5 is a bottom plan view of the grid electrode of FIG. 3.
Figure 6:
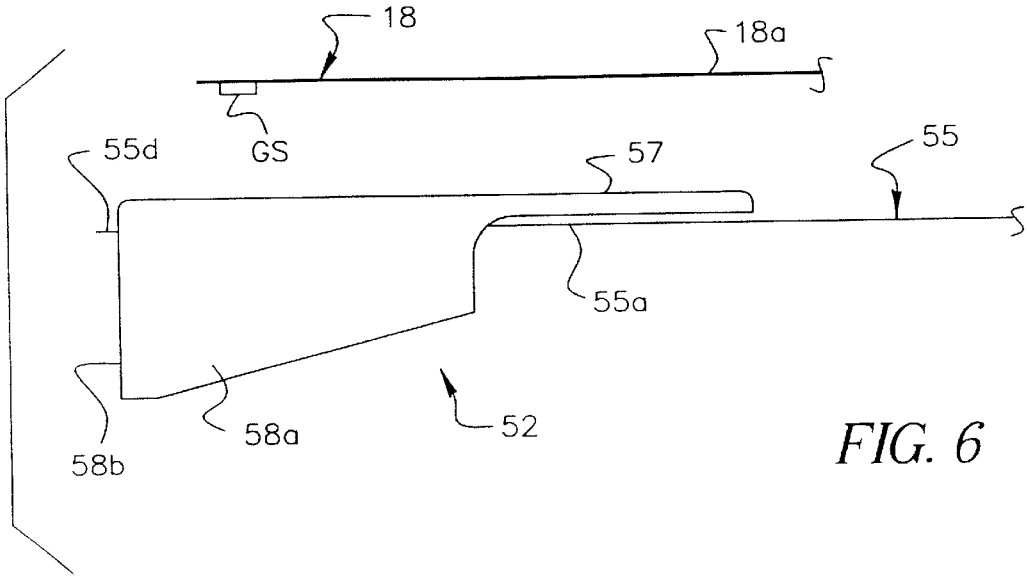
FIG. 6 is a side elevational view of the portion of the grid electrode of FIG. 3 but showing an end portion of the grid electrode.

With reference now to FIG. 2 there is shown a corona charger and grid 28 having a grid electrode 50 formed in accordance with the invention. The grid electrode is mounted on a housing of the charger by engagement of lugs on the housing which extend through apertures formed on end cap members 52, 54 formed at the ends of the longitudinally extending grid wires.

Figure 7:
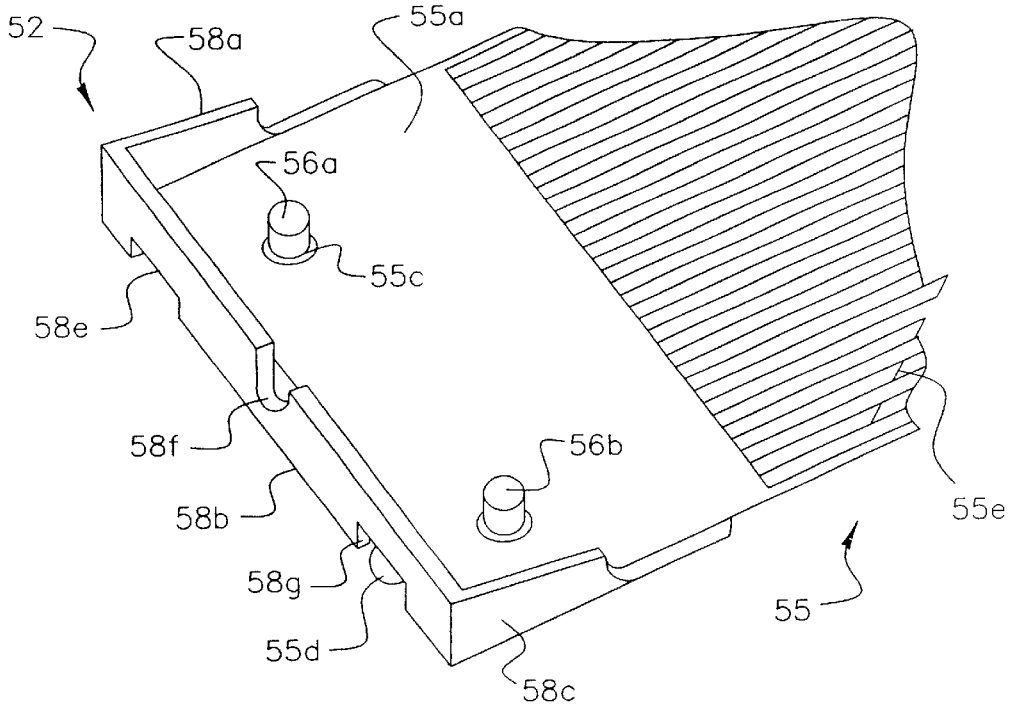
FIG. 7 is a perspective view of the end portion of the grid electrode shown in FIG. 6 but illustrating a bottom view of this portion and before pins have been deformed to secure a metallic plate of the grid to plastic end caps.

With reference now to FIGS. 3–7 various views of the grid electrode forming a preferred embodiment of the invention are illustrated. The grid electrode 50 includes a series of grid wires 55 extending generally parallel to each other in the longitudinal direction of the wires. At each of the ends of the wires are flat metallic plate members 55*a, b* respectively. The wires and end plates may be formed from the same sheet metal with the wires being formed by selectively etching away material such as through a photoetching process. The grid electrode may have adjacent wires connected to one another by transverse connecting segments 55*e* as shown (FIG. 7).

Metallic plate members 55*a, b* each include two apertures 55*c* etched or drilled through the plate members to allow pins 56*a*, 56*b* formed on an otherwise flat surface forming the underside of end cap members 52, 54 which end caps are substantially identical. The end cap members 52, 54 are molded plastic members and are substantially rigid and electrically insulative. A preferred material for the end cap is a polyphenylene oxide plastic with glass filler such as a Norel™ plastic by General Electric, however, other highly insulative durable plastic materials may also be used. The pins 56*a*, 56*b*, and cover segment 57 and depending walls 58*a, b, c* are all molded integral together as part of the end cap. During manufacture of the grid electrode 50 the end cap members 52, 54 are assembled to the metallic plate members 55*a, b* and the pins 56*a, b* arc compressed under heat and/or pressure to deform them to tightly secure the end cap members to the plate members.

The end cap depending wall 58*b* includes at least one and preferably more apertures 58*e, g*, and notch 58*f* therethrough that allow mounting and locating lugs from the corona charger housing (not shown) to be engaged therein so that the grid electrode may be accurately located and secured to the corona charger assembly housing.

One of the metallic plate members 55*a* includes a tab extension 55*d* that extends through aperture 58*g* to allow a service person to gain access to the grid with a probe to measure the voltage potential on the grid. When assembled on the corona charger housing assembly, a leaf spring on the assembly that is electrically biased may be used to contact a metallic end plate to establish the electrical potential of the grid electrode.

As may be seen in FIG. 7 the outer grid wires are made substantially thicker than inner grid wires to protect against breakage. Additionally, one of the metallic plate members may be etched with the word "REAR" to identify which end of the grid electrode is to be mounted on the rear portion of the corona charger housing assembly. When mounted on the corona charger assembly, the grid electrode 50 faces the photoconductive member and surface 18*a* thereof and is generally parallel to the surface 18*a*, and the longitudinal direction of the grid wires extends perpendicular to or at least transverse to the direction of movement of the surface 18*a*A ground stripe, GS (shown schematically in FIG. 6) is typically provided adjacent at least one edge of the photoconductive belt and cover segment 57 is parallel to and opposite facing to the ground stripe GS. However, the cover segment 57 is highly electrically insulative and preferably greater than 0.5 mm and more preferably at least 0.75 mm and still more preferably 1 mm or more thick but less than the spacing between the grid wires and the surface 18*a* being charged. The cover segment 57 has a surface that overlies and is in planar contact engagement with a substantial portion of a respective plate member. The cover segment is relatively durable and can be expected to holdup significantly longer than a tape. The cap member is relatively rigid so as to be able to support the grid electrode in a plane and provides high electrical resistivity to be a substantial insulator.

Figure 8:
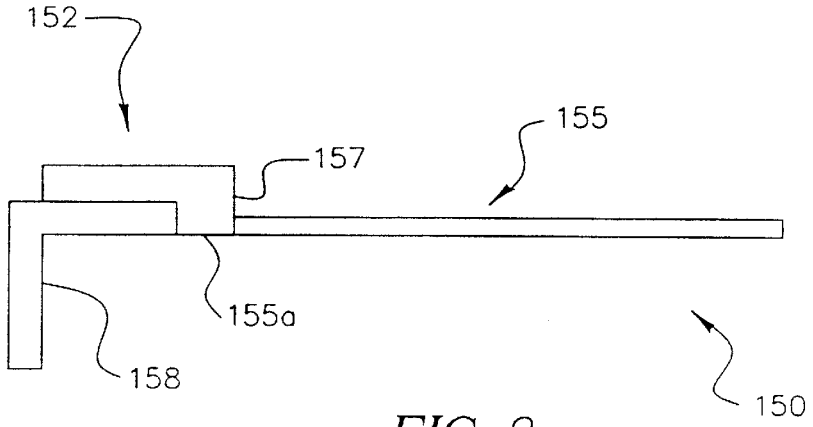
FIG. 8 is a side elevational view of an end portion of a grid electrode in accordance with a first alternate embodiment of the invention.

FIG. 8 is a first alternative embodiment of the invention. In the grid electrode 150 embodiment of FIG. 8 the grid wires 155 and metallic plate members 155*a* shown in FIG. 8 are identical to that of the embodiment described with reference to FIGS. 3–7. The cap member 152, however, is formed of two different materials. In the embodiment of FIG. 8 the cap member at each end of the grid electrode includes a cover segment 157 having a surface that overlies and is in planar contact engagement with a substantial portion of each respective plate member 155*a*. The plastic plate material is of a thickness of at least 0.75 millimeters and preferably lmm or slightly greater. A cover segment is preferably formed of a molded plastic material that is substantially electrically insulative. The cover segment, when this grid electrode 150 is mounted on a corona charger housing, would be positioned opposite the ground stripe as similarly shown in FIG. 6 for the embodiment of FIGS. 3–7. A depending portion 158 of the cap member is formed of metal and is either integrally molded with the cover segment 157 or mechanically attached by suitable means such as rivets or other mechanical fasteners or adhesives. Similar apertures may be formed in the depending portion of the end cap for use in mounting the grid electrode 150 to the corona charger housing as described for the embodiment of FIGS. 3–7.

Figure 9:
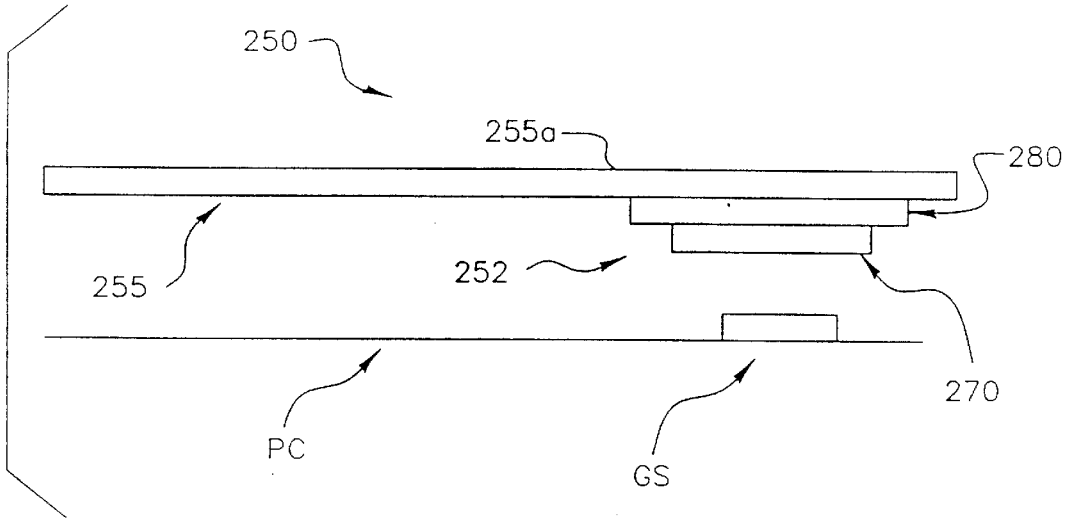
FIG. 9 is a side elevational view in schematic of an end portion of a grid electrode in accordance with a second alternate embodiment of the invention.

The embodiment of FIG. 9 is a third alternative embodiment of a grid electrode of the invention. In the embodiment of FIG. 9 the grid electrode to 152 includes grid wires to 255 and metallic plate members that may be identical to that of the embodiment of FIGS. 3–7. However, the end cap structure to 252 at the grid ends is in the form of an electrical sandwich construction. The sandwich construction includes two conductive surfaces separated by a semiconductive substrate. One of the conductive surfaces comprises the flat metallic plate member 255*a* formed at each of the longitudinal ends of the wires. A second electrically conductive surface is formed by a conductive plate or pad 270. Between the conductive pad 270 and metallic plate member 255*a* there is provided a semiconductive substrate 280. The conductive pad 270 will have its electrical voltage potential rise or float up to the voltage potential of the grid wires during normal operation. When the ground stripe touches the grid, it would come in contact with the conductive pad. The pad 270 would short to ground, however, the grid wires would remain at the proper potential level. The substrate material 280 may be insulating or highly resistant, so that the leakage current across the substrate would be insignificant. The conductive pad would create uniform electrical field across the substrate thus preventing high field concentration points that could cause electrical breakdown of the material. This way the substrate could be very thin preventing a significant increase in the thickness of the grid element.

Figure 10:
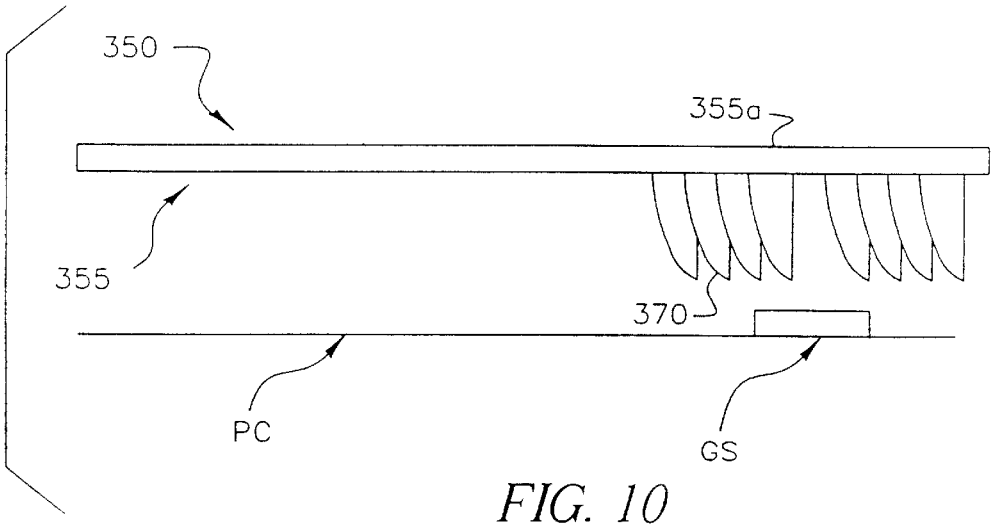
FIG. 10 is a side elevational view in schematic of an end portion of a grid electrode in accordance with a third alternate embodiment of the invention.

With reference to FIG. 10. which illustrates a fourth alternative embodiment of the invention there is shown a grid electrode 350 for use with a corona charger. In the embodiment to FIG. 10 the grid wires 355 and flat metallic plate members 355*a* associated with the grid wires are similar to those described for the embodiment of FIGS. 3–7. In the embodiment of FIG. 10 the respective cap members are each attached to a respective metallic plate member at the respective ends of the grid electrodes described previously. Each cap member covers each metallic plate member. Cap members each include a cover segment having a surface that overlies and is in planar contact engagement with a substantial portion of the respective plate member with a thickness sufficient to extend from the grid electrode to engage the ground stripe as shown in FIG. 10. Thus, in the embodiment of FIG. 10 a semiconductive brush head 370 is between the ground stripe GS of the photoconductive film PC and the grid electrode. During operation of the machine, the brush head 370 may be in light contact with the ground stripe. Any leakage current flowing through the conductive pad would be low enough to prevent interference with the proper level of grid potential when a voltage potential is applied to the grid electrode. The conductive nature of the pad would prevent high energy arcing from occunring. The pad could also provide a secondary function by lightly cleaning the film stripe. These pads could be vacuumed during each service call to remove the toner paper dust that has collected on them. An added benefit would be prevention of film scratching as the charger is installed or removed. The cover segment is formed of a semiconductor brush pad. The pad may be secured to the plate member by suitable connecting means such as mechanical attaching devices as described for the embodiment of FIGS. 3–7 or using mechanical connectors such as screws and the like or an adhesive which is preferably electrically conductive.

The invention has been described in detail with particular reference to certain preferred embodiments thereof, but it will be understood that variations and modifications can be effected within the spirit and scope of the invention.

What is claimed is:

1. A grid electrode for attachment to a corona charger, the grid electrode comprising:

a series of substantially parallel grid wires extending in a longitudinal direction;

a pair of flat metallic plate members formed integral with the grid wires at respective longitudinal ends of the grid wires, the flat plate members each including at least one aperture; and an end cap member of insulative material connected to each plate member, the cap members each including a cover segment having a surface that overlies and is in planar contact engagement with a substantial portion of each plate member with a thickness of at least 0.5 millimeters and the cover segment being formed of a molded plastic material that is substantially electrically insulative, the cap members each including a depending portion also of plastic material and integrally molded with the cover segment, at least one aperture being formed in the depending portion for use in mounting the grid electrode, the cover segment including at least one pin integrally molded to the surface of each cover segment, the pin extending through the aperture in each plate member and being deformed to connect the cap member to the plate member.

2. The grid electrode of claim 1 and including an electrically conductive tab located on one end of one of the plate members and the tab extending through an aperture in the depending portion for providing access for measuring voltage potential on the grid electrode.

3. The grid electrode of claim 2 in combination with a corona charger wire, the corona charger wire being spaced from the grid electrode.

4. The grid electrode of claim 1 in combination with a corona charger wire, the corona charger wire being spaced from the grid electrode.

5. The grid electrode of claim 1 wherein the cap members have a thickness of at least 1 mm.

6. A grid electrode for attachment to a corona charger, the grid electrode comprising:

a series of substantially parallel grid wires extending in a longitudinal direction;

a flat metallic plate member formed integral with the grid wires at one longitudinal end of the grid wires;

a cap member connected to the plate member, the cap member including a cover segment having a surface that overlies and is in planar contact engagement with a substantial portion of the plate member with a thickness of at least 0.5 millimeters and the cover segment being formed of a material that is substantially electrically more resistive than the plate member.

7. The grid electrode of claim 6 wherein the cap member includes a dependent portion that is integrally connected with the cover segment.

8. The grid electrode of claim 6 wherein the cover segment includes a semiconductive substrate which is in planar contact engagement with the plate member and a conductive pad which overlies the semiconductive substrate so that the semiconductive substrate is between the conductive pad and the plate member.

9. The grid electrode of claim 8 in combination with a corona charger and a photoconductive member, the grid electrode being spaced between the photoconductive member and the corona charger, and the photoconductive member including a ground stripe opposite the conductive pad.

10. The grid electrode of claim 6 wherein the cover segment includes a semiconductive brush pad.

11. The grid electrode of claim 10 in combination with a corona charger and a photoconductive member, the photoconductive member including a ground stripe and the semiconductive brush pad engaging the ground stripe.

12. The grid electrode of claim 6 in combination with a corona charger and a photoconductive member, the photoconductive member including a ground stripe that is opposite the cover segment.

* * * * *